US007621153B2

(12) United States Patent
Winans

(10) Patent No.: US 7,621,153 B2
(45) Date of Patent: Nov. 24, 2009

(54) PIERCED EARRING PROTECTION PAD

(76) Inventor: Vivian Winans, 600 S. Hill Rd., Bloomfield Hills, MI (US) 48302

( * ) Notice: Subject to any disclaimer, the term of this patent is extended or adjusted under 35 U.S.C. 154(b) by 432 days.

(21) Appl. No.: 11/592,916

(22) Filed: Nov. 3, 2006

(65) Prior Publication Data

US 2007/0101764 A1 May 10, 2007

Related U.S. Application Data

(60) Provisional application No. 60/733,581, filed on Nov. 4, 2005.

(51) Int. Cl.
*A44C 7/00* (2006.01)

(52) U.S. Cl. ..... 63/13; 24/705; 63/33

(58) Field of Classification Search ..... None
See application file for complete search history.

(56) References Cited

U.S. PATENT DOCUMENTS 1,971,216 A * 8/1934 Gould ..... 63/14.3
5,638,701 A * 6/1997 Dempsey ..... 63/12

* cited by examiner

*Primary Examiner*—Jack W. Lavinder
(74) *Attorney, Agent, or Firm*—The Weintraub Group, PLC

(57) ABSTRACT

A protection pad for a pierced earlobe and an arrangement and method of securing and/or supporting an earring to the earlobe of a user, using the protection pad, and in a manner that attachment of an earring to the earlobe provides less discomfort to the user, obviates damage that might be occasioned to the earlobe from such attachment, and reduces loss of ornaments used in connection with such affixing and arising for inadvertent attachments.

10 Claims, 1 Drawing Sheet

PIERCED EARRING PROTECTION PAD

CROSS-REFERENCE TO RELATED APPLICATION

This Application claims the benefit of U.S. Provisional Application Ser. No. 60/733,581, filed on Nov. 4, 2005, the contents of which are incorporated herein by reference in its entirety for all that is taught and disclosed therein.

BACKGROUND OF THE INVENTION

1. Field of the Invention

The present invention pertains to earrings and in particular to an earlobe protection pad for supporting earrings. More particularly, the invention is directed to a protection pad for supporting pierced earrings.

2. Description of the Prior Art

The use of earrings is well known. In general, a decorative item is secured to the earlobe, such as by a clamp engaging opposite sides of the earlobe, or the earlobe being pierced and the earring being retained thereto by passing a pin of the earring through the hole and into engagement with a retention clip The full weight of an earring in clamped relation to the earlobe can be uncomfortable, especially if heavy or worn for a long period of time. This is even more so with a pierced ear. The pierced earring is typically supported by the bottom edge of the hole formed in the wearer's earlobe. Structural support and protection of the earlobe, which is commensurate with the size and weight of the earring, would be desirable in that such would make such wearing comfortable to the wearer.

Additionally, medium to heavy pierced earrings, such as dangling or loop earrings, pull down on the hole in the wearer's earlobe so that the hole becomes a very unattractive slit. This downward weight also distorts the shape of the earlobe and may even tear the skin of the earlobe. Similarly, an inadvertent pull on the earring may easily cause tearing of the earlobe.

Various attempts to ameliorate the problems associated with pierced earrings have been suggested, such as by the provision of protection pads. By way of example, attention is drawn to arrangements disclosed in U.S. Pat. Nos. 1,971,216 (Gould); 2,763,999 (Norman); 4,974,430 (Turner); 5,444,994 (Poortinga et al.); 5,537,841 (Bradvica); 5,638,701 (Dempsey); 5,769,995 (Greyerbiehl); and 6,003,333 (Stevens).

While these arrangements may have been suitable for the uses then intended, there is an ongoing need for improvements to obviate the problems of attaching an earring to an earlobe.

For example, wearers sometimes complain of the loss of earring ornaments and retention clips, discomfort, difficulty in affixing, or combinations thereof, with regard to existing earring usage.

It would be desirable to provide an improved attachment and arrangement for attaching an earring to a pierced earlobe that reduces stress to the user's earlobe and discomfort to the user while wearing the earring, aids in affixing, securing or otherwise holding the earring in place, and supports and protects the earlobe from tearing.

SUMMARY OF THE INVENTION

The present invention is directed to a protection pad for a pierced earlobe and an arrangement and method of securing and/or supporting an earring to the earlobe of a user, using the protection pad of the invention, and in a manner that the attachment of an earring to the earlobe provides less discomfort to the user, obviates damage that might be occasioned to the earlobe from such attachment, and reduces loss of ornaments used in connection with such affixing and arising for inadvertent attachments According to a preferred embodiment of this invention, a method of supporting an earring on a wearer's earlobe, wherein a hole extends between the front and back sides of the earlobe, comprises the steps of:

providing an oval shaped protection pad of a size such that it may be affixed to the back side of a wearer's earlobe and is bounded by the earlobe, the pad comprising a generally planar sheet of compressible cushion material and a toroidal shaped ring of flexible polymeric material affixed to the sheet of cushion material in a manner that an annular surface of the ring is above the sheet of cushion material and an oval shaped surface in the center of the cushioning sheet encircled by the annular surface of the ring is exposed, the annular and oval shaped surfaces having adhesive thereon, adhesively fixing the annular and oval surface portions of the pad to the back of the earlobe so that the pad is bounded by the earlobe, the annular shaped surface of the sheet encircles the exit of the earring hole in the earlobe and the central oval shaped surface of the cushioning sheet superposes the hole exit, and after said pad is affixed to said earlobe, inserting a support portion of an earring through the front entry of said earring hole and upon further insertion, pushing said support portion against said pad with sufficient force so as to pierce the cushioning sheet of said pad, such that the weight of said earring is then supported, at least partially, by said pad adhesively secured to said back of the earlobe.

According to this method, preferably the steps further comprise securing a retention clip to the forward end portion of the support portion of the earring, the securing including pushing the retention clip into engagement with and against the oval shaped surface in the center of the cushioning sheet, whereby the oval shaped center portion of the cushioning sheet is more firmly compressed into substantially flush engagement against the back side of the earlobe.

Depending on the application, according to this invention, the center area of the cushioning sheet may be without (i.e., devoid of) adhesive.

According to another preferred embodiment, a earlobe piercing system comprises:

a piercing element adapted to being driven through a piercing hole extending through and between front and back sides of the earlobe, the piercing element comprising a cylindrical ear piercing post having a pointed front end, a retention clip for removable connection to the front end portion of the cylindrical post, and a protection pad for attachment to the back of the earlobe, the protection pad comprising a generally flat shaped disc and a shaped ring secured atop the disc to define engagement surfaces adapted to engage the back of the earlobe, the ring being of a soft flexible material and adapted to reside substantially flush against the back of the earlobe, and the flat disc being of a compressible material to receive and be pierced by the pointed front end of the piercing element, compress, and cushion inward forces from the retention clip when attached to the post and driving the center portion of the disc into substantially flush engagement with the back of the earlobe.

In a preferred aspect of this embodiment, the flat disc is oval shaped, generally planar, thin, and comprised of a firm compressible fabric material, and the ring is annular shaped, planar, thin and comprised of a flexible material, such as a polymer or elastomer. The oval disc is configured that to be encircled by the outer periphery of the annular ring.

Preferably, the protection pad is dimensioned so as to superpose the shape of the earlobe, without extending below or around the earlobe.

According to an aspect of this embodiment, the annular disc of the protection pad is modified in that a rectangular cross section formed by the flat planar element just described is replaced by a toroidal shaped ring atop the cushioning sheet.

According to another preferred embodiment, an earlobe support pad for use with a pierced earring when the earring is secured to a piercing hole of the earlobe, comprising a thin sheet of resilient material having a ring shape for positioning the pad on the earlobe in centered relation about the piercing hole, and a thin sheet of compressible fabric having an oval shape and a thickness capable of in situ piercing by the piercing post of the earring, the ring and sheet defining an adhesive surface that is adapted, at least in part, to reside substantially flush against the back of the earlobe and superposed with the piercing hole, the fabric being encircled by the ring and of a thickness to cushion the earlobe when the earring is supported thereon.

According to an aspect of this embodiment, both sides of the fabric sheet may include a coating of adhesive, at least in part, wherein the adhesive on one side thereof will adhere to the earlobe and on the obverse side thereof will operate to adhere to an earring retention clip commonly used with the earring whereby to position and retain the retention clip in centered relation with the piercing hole.

The present invention will be more clearly understood with reference to the accompanying drawings and to the following Detailed Description, in which like reference numerals refer to like parts and where:

DETAILED DESCRIPTION OF THE PREFERRED EMBODIMENT

Figure 1:
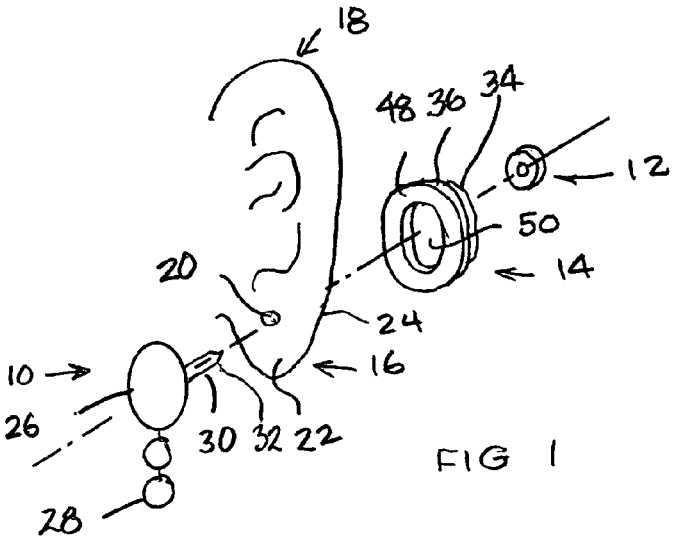
FIG. 1 is an exploded perspective view of an arrangement according to this invention wherein an earring, a retention clip, and a protection pad are positioned for attachment to the pierced earlobe of a person's ear.

Turning now to the drawings, FIG. 1 illustrates FIG. 1 is an exploded perspective view of an arrangement according to this invention wherein an earring 10, a retention clip 12, and a protection pad 14 are positioned for attachment to the pierced earlobe 16 of a person's ear 18. The earlobe 16 is generally flat and contoured and a hole 20 extends between the front and back 22 and 24 of the earlobe.

The earring 10 includes a frame or base 26 which is adapted to engage the front 22 of the earlobe, an ornamental portion 28 that hangs from the base, or otherwise connected thereto, and an elongated cylindrical post or stem 30 that extends from the base 26 and terminates in a sharp or pointed forward end portion 32. In use, the earring 10 is positioned and centered relative to the front 22 of the earlobe, and the stem 30 is driven through the hole 20.

So positioned, the retention clip 12 is then secured to the forward end portion 32 of the stem 30, the base 26 of the earring moved so as to be flush against the front 22, and the clip 12 moved so as to be flush against the back 24. Such clamping is known and could lead to discomfort or other problems, as described herein above.

According to this invention, and referring to FIGS. 1-4, the protection pad 14 is first secured to the back 24 of the earlobe, whereupon the earring 10 and clip 12 are attached to the earlobe.

Figure 3:
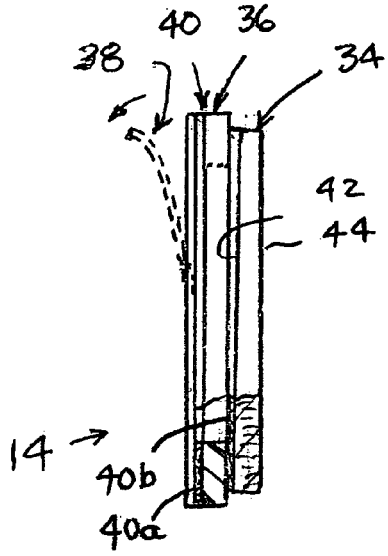
FIG. 3 is a side elevation view of the protection pad of FIG. 2, partially in section, to show an annular ring, which mounts directly to an earlobe, and a cushion layer and peel-off adhesive backing sheet, which are attached to opposite sides of the annular ring.
Figure 2:
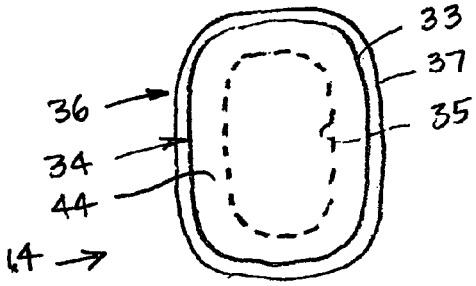
FIG. 2 is a plan view of one side of the protection pad of FIG. 1, according to this invention.

Referring to FIGS. 2 and 3, the protection pad 14 comprises a generally flat oval disc 34, an oval shaped ring 36, and a backing sheet 38 removably attached in covering relation to adhesive 40 provided on a front mounting face of the pad. The protection pad 14 is adapted to be adhesively mounted to the back 24 of the earlobe 16 and configured to fit onto the back of the earlobe in a manner that the pad does not extend beyond, under, or around the earlobe.

The oval disc 34 is thin, includes upper and lower surfaces 42 and 44, and forms a cushion that is, at least in part, adapted to be abutted against the back 24 of the earlobe. Preferably, the disc or cushion 34 is comprised of a fabric, a polymer, an elastomer, or a composite that imparts flexibility to the material and enables the material to be punctured by the forward end portion 32 of the stem. In this regard, the material of the disc 34 is compressible, at least in part, and capable of compressing to cushion inward clamping forces from the retention clip 12 when attached to the post 30 and driving a center portion 45 of the cushioning disc 34 into substantially flush engagement with the back 24 of the earlobe 16.

The oval shaped ring 36 is thin, mounted atop the upper surface 42 of the cushioning disc 34, and has generally oval shaped inner and outer surfaces 35 and 37. The outer periphery or surface 37 of the ring 36 is generally congruent to and encircles the outer periphery 33 of the cushion disc 34. So mounted and positioned, the ring 36 defines an annular surface 48 that encircles and exposes a center portion or surface 50 of the upper surface 42 of the cushioning disc 34.

Preferably, the ring 36 is comprised of a flexible polymer or elastomer (e.g., rubber) to enable the disc to flex and bend relative to the somewhat supple material of the earlobe to which attached.

While the annular ring 36 is preferably flat and thin (i.e., rectangular in cross-section), the ring may form a toroid (i.e., the cross-section of the ring is defined by a circle rotated 360°).

Figure 4:
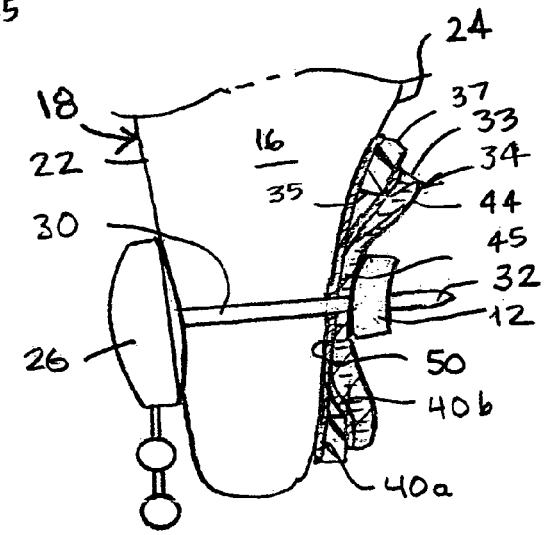
FIG. 4 is a side elevation view, partially in section, of the earring, the retention clip, and the protection pad, illustrated in FIG. 1, when secured to the earlobe.

Preferably, the adhesive 40 is provided on the annular surface 48 of the ring 36 (identified at 40*a* in FIG. 4) and on the central surface 50 of the cushioning disc 34 (identified at 40*b* in FIG. 4).

The backing sheet 38 protectively covers the layer of adhesive 40 until the protective pad 14 is to be mounted to the back 24 of the earlobe, whereupon the sheet 38 is removed and the pad mounted to the earlobe. In FIG. 3, a portion of the sheet 38 (shown in phantom) is shown being peeled back from covering relation with the adhesive.

Preferably, the adhesive 40 enables the protective pad 14 to be retained in position on the earlobe and not slide or otherwise move once mounted thereto. To avoid any adverse reactions from contact with the earlobe, the adhesive is hypoallergenic.

The materials of the protection pad 14 are suitably compliant and flexible to enable the disc 34 and ring 36 thereof to reside substantially flush against the earlobe.

FIG. 4 is a side elevation view, partially in section, of the earring 10, the retention clip 12, and the protection pad 14, when secured to the earlobe. As can be seen, the outer annular surface 48 and central surface 50 are secured to the back 24 by the adhesive portions 40*a* and 40*b*, and these surfaces are, at least in part, flush with the back 24 of the earlobe.

A method of supporting an earring 10 on a wearer's earlobe 16, wherein a piercing hole 20 extends between the front and backsides 22 and 24 of the earlobe, will now be described. First, there is provided an oval shaped protection pad 14, according to this invention and as described hereinabove. The pad 14 is of a size such that it may be affixed to the backside 24 of a wearer's earlobe 16 without extending around, under or below the earlobe.

The backing sheet 38 is removed, exposing the adhesive layer 40 provided by the adhesive portion 40*a* on the annular surface 48 of the ring 36, and adhesive portion 40*b* provided on the oval shaped surface 50 in the center of the cushioning disc 34.

The annular and oval surface portions 48 and 50 of the pad 14 are adhesively affixed to the back 24 of the earlobe in a manner that the pad does not extend beyond, under, or around the earlobe. Further, the annular shaped surface 48 of the ring 36 encircles the exit of the earring hole 20 opening on the back side 24 in the earlobe and the central oval shaped surface 50 of the cushioning sheet 34 superposes the hole exit.

After the protection pad 14 is affixed to the earlobe 16, the support portion or piercing stem 30 of the earring is inserted through the front entry of said earring hole 20 on the front side 22 of the earlobe. Upon further insertion, the forward end 32 of the support portion is pushed against the cushioning disc 34 with sufficient force so as to pierce the cushioning material. The protective pad adhesively secured to the back of the earlobe then supports the weight of the earring, at least partially.

Finally, the retention clip 12 is secured to the forward end portion 32 of the stem 30 of the earring. The securing includes pushing the retention clip 12 into engagement with and against the exterior oval shaped surface 44 in the center of the cushioning sheet 34, whereby the adhesively coated oval shaped interior surface 42 of the cushioning sheet 34 is more firmly compressed against the earlobe.

In an important feature herein, the materials of the protection pad may be appropriately colored to match the skin of the color. For example, the colors may be in shades appropriate to persons of color, or the flesh tones of Caucasian users.

Further, although discussed in connection with pierced earrings, the reader will appreciate that the benefits of the protection pad 14 according to this invention apply equally for use with earrings wherein opposed clamping elements are driven against the front and back sides 22 and 24 of the earlobe.

The foregoing description of preferred embodiments of the invention has been presented for the purposes of illustration and description. It is not intended to be exhaustive or to limit the invention to the precise form disclosed. Many modifications and variations are possible in light of the above teaching. Such modifications and variations are deemed to be within the scope if this invention.

Having thus described the invention, what is claimed is:

1. A method of supporting an earring on a wearer's earlobe, wherein a hole extends between the front and back sides of the earlobe, comprising:

providing an oval shaped protection pad of a size such that it may be affixed to the back side of a wearer's earlobe and is bounded by the earlobe, the pad comprising a generally planar sheet of compressible cushion material and a toroidal shaped ring of flexible polymeric material affixed to the sheet of cushion material in a manner that an annular surface of the ring is above the sheet of cushion material and an oval shaped surface in the center of the cushioning sheet encircled by the annular surface of the ring is exposed, the annular and oval shaped surfaces having adhesive thereon;

adhesively fixing the annular and oval surface portions of the pad to the back of the earlobe so that the pad is bounded by the earlobe, the annular shaped surface of the sheet encircles the exit of the earring hole in the earlobe and the central oval shaped surface of the cushioning sheet superposes the hole exit, and after said pad is affixed to said earlobe, inserting a support portion of an earring through the front entry of said earring hole and, upon further insertion, pushing said support portion against said pad with sufficient force so as to pierce the cushioning sheet of said pad, such that the weight of said earring is then supported, at least partially, by said pad adhesively secured to the back of said earlobe.

2. The method of claim 1 which further comprises:

securing a retention clip to the forward end portion of the support portion of the earring.

3. The method of claim 2 wherein the retention clip is secured by pushing the retention clip into engagement with and against the oval shaped surface in the center of the cushioning sheet, whereby the oval shaped center portion of the cushioning sheet is more firmly compressed into substantially flush engagement against the back side of the earlobe.

4. The method of claim 1 wherein the center area of the cushioning sheet is devoid of adhesive.

5. An earlobe piercing system comprising:

a piercing element adapted to being driven through a piercing hole extending through and between front and back sides of the earlobe the piercing element comprising a cylindrical ear piercing post having a pointed front end, a retention clip for removable connection to the front end portion of the cylindrical post, and a protection pad for attachment to the back of the earlobe, the protection pad comprising a thin, compressible, substantially planar, fabric material generally flat shaped disc and a shaped soft, flexible, substantially planar ring secured atop the disc to define engagement surfaces adapted to engage the back of the earlobe, the ring residing substantially flush against the back of he earlobe, the disc being encircled by the outer periphery of the ring, and wherein the flat disc is received and pierced by the pointed front end of the piercing element, compressing the ring and cushioning inward forces from the retention clip when attached to the post and driving the center portion of the disc into substantially flush engagement with the back of the earlobe.

6. The system of claim 5, wherein the protection pad is dimensioned so as to superpose the shape of the earlobe, and is bounded thereby.

7. The system of claim 5, wherein the disc is oval shaped and the ring is annular.

8. The system of claim 5, wherein the disc is a toroidal shaped ring seated atop the cushioning sheet.

9. An earlobe support pad for use with a pierced earring when the earring is secured to a piercing hole of the earlobe, comprising:

a thin sheet of resilient material having a ring shape for positioning the pad on the earlobe in centered relation about the piercing hole, and a thin sheet of compressible fabric having an oval shape, and a thickness capable of in situ piercing by the piercing post of the earring, the ring and sheet defining an adhesive surface that is adapted to reside substantially flush against the back of the earlobe and superposed with the piercing hole, and the ring being adhered to the fabric such that the outer periphery of the ring extends beyond the outer periphery of the fabric, the fabric of a thickness to cushion the earlobe when the earring is supported thereon.

10. The support pad of claim 9 wherein:

both sides of the fabric sheet may include a coating of adhesive, at least in part, and wherein the adhesive on one side thereof will adhere to the earlobe and on the obverse side thereof adhere to an earring retention clip to position and retain the retention clip in centered relation with the piercing hole.

* * * * *